US005111985A

United States Patent [19]

Lapeyre

[11] Patent Number: 5,111,985

[45] Date of Patent: May 12, 1992

[54] RECEPTACLE FOR DISPENSING A CONTINUOUS WEB OF PAPER FROM A ROLL

[76] Inventor: Fernard S. Lapeyre, 1224 Octavia St., New Orleans, La. 70115

[21] Appl. No.: 505,777

[22] Filed: Apr. 6, 1990

[51] Int. Cl.[5] ..... B26F 3/02

[52] U.S. Cl. ..... 225/51; 225/53; 225/54

[58] Field of Search ..... 225/49, 50, 51, 52, 225/53, 54

[56] References Cited

U.S. PATENT DOCUMENTS

| | | | |
|---|---|---|---|
| 756,019 | 3/1904 | Hirsch . | |
| 1,372,218 | 3/1921 | Davidson . | |
| 1,387,167 | 8/1921 | Peck . | |
| 1,423,336 | 7/1922 | Koritke | 225/54 |
| 1,814,200 | 7/1931 | Wheat . | |
| 1,866,130 | 7/1932 | Reichel . | |
| 1,946,105 | 2/1934 | Parlett | 242/55.2 |
| 2,276,414 | 3/1942 | Morehouse et al. | 225/52 |
| 2,342,564 | 2/1944 | Van Saun | 229/47 |
| 2,649,239 | 8/1953 | Ellsworth | 229/33 |
| 2,668,022 | 2/1954 | Fairfield | 225/51 |
| 2,737,337 | 3/1956 | Moore | 229/44 |
| 2,864,493 | 12/1958 | Holcombe | 206/52 |
| 2,876,892 | 3/1959 | Coons | 206/52 |
| 3,016,135 | 1/1962 | Green, Jr. | 206/52 |
| 3,642,125 | 2/1972 | Johnson | 206/47 |
| 3,794,238 | 2/1974 | Egli | 229/44 |
| 4,384,664 | 5/1983 | Roos | 225/106 |
| 4,467,974 | 8/1984 | Crim | 242/55.53 |
| 4,474,318 | 10/1984 | Perrin | 225/50 |
| 4,714,191 | 12/1987 | Richardson | 229/121 |

*Primary Examiner*—Douglas D. Watts
*Assistant Examiner*—John M. Husar
*Attorney, Agent, or Firm*—Pravel, Gambrell, Hewitt, Kimball & Krieger

[57] ABSTRACT

A dispenser for roll paper includes a receptacle body having front and rear sidewalls, left and right sidewalls, a bottom and a top pivotally attached to the rear sidewall, covering an opening for adding the roll to the interior space. A recess formed in the lid defines an opening that allows the users fingers to grasp the free end of the web at the recess. A slot between the lid and front wall of the receptacle allow the web to be dispensed, and an arm suspended from the inside of the receptacle holds the free end of the web against the front of the receptacle and adjacent the recess, in a position that allows the user to easily grab the free end of the web.

5 Claims, 2 Drawing Sheets

RECEPTACLE FOR DISPENSING A CONTINUOUS WEB OF PAPER FROM A ROLL

BACKGROUND OF THE INVENTION

1. Field of the Invention

The present invention relates to devices for the dispensing of roll paper i.e. a continuous web of paper stored on a roll. Paper of this type typically is used for paper towels, hand towels, toilet tissue, writing paper, and print paper as used in printing presses, printers and in some office machines for example.

2. General Background

In the dispensing of paper from a roll, there is provided a free end portion or web that unrolls constantly as the roll depletes. This unwinding free end portion of the paper is referred to herein as the web and the free end of the web which is that portion of the paper being consumed at the time that it is unwound. A problem exists in that if the web is not frictionally held in some fashion, it can easily unroll excessively, often wasting a length of the paper web. Another problem that exists is a problem of cleanly and neatly tearing the web after a desired portion of the web has been dispensed from the container.

Various devices have been patented which relate to the dispensing of a web of paper from a roll of for example many feet in length, for example:

U.S. Pat. No. 756,019 issued to M. Hirsch and entitled "Folding Box"; U.S. Pat. No. 1,372,218 issued to F. B. Davidson and entitled "Container"; U.S. Pat. No. 1,387,167 issued to A. S. Peck and entitled "Caddy Box"; U.S. Pat. No. 1,814,200 issued to R. E. Wheat and entitled "Paper Holder"; U.S. Pat. No. 1,866,130 issued to F. Reichel and entitled "Dispensing Carton"; U.S. Pat. No. 1,946,105 issued to A. H. Parlett and entitled "Sanitary Dispensing Cabinet For Surgical Gauze and the Like".

Other patents relating to dispensers include U.S. Pat. No. 2,342,564 issued to R. H. Van Saun entitled "Container"; U.S. Pat. No. 2,649,239 issued to R. C. Ellsworth entitled "Sealed Container"; U.S. Pat. No. 2,737,337 issued to G. A. Moore entitled "Container and Container Blank Assembly"; U.S. Pat. No. 2,864,493 issued to H. N. Holcombe entitled "Dispensing Container"; U.S. Pat. No. 2,876,892 issued to F. P. Coons entitled "Dispensing Package"; and U.S. Pat. No. 3,016,135 issued to F. E. Green, Jr. entitled "Dispensing Package and Box For Strip Materials".

U.S. Pat. No. 3,642,125 issued to Johnson entitled "Carton and Package" shows a carton of foldable material adapted for forming a package containing a flat object and a cylindrical object both of which are securely maintained in the finished carton.

U.S. Pat. No. 3,794,238 issued to Egli and entitled "Reclosable Rectangular Cardboard Box" shows a reclosable cardboard box with a cover that is swingable about a folding line on the upper edge of the rear wall and has on its front edge a downwardly extending strip overlapping the outer upper margin of the front wall when the cover is closed. Slot-shaped recesses are provided at the ends of the folding line between the cover and said strip for yieldably receiving locking projections formed on the front ends of horizontally disposed flaps which extend from said side walls into the box.

U.S. Pat. No. 4,467,974 issued to Crim entitled "Bathroom Tissue Dispenser" shows a dispenser for perforated bathroom tissue and the like. The dispenser includes a housing defining a generally cubical chamber adapted to receive a roll of paper tissue. A cover is pivotally connected to the housing, the cover including a support member and a tension member mounted on said housing for combined pivotal and translatory movement between a dispensing position in which the support member and the tension member cooperate to define a dispensing guide path therebetween and a loading position in which the support member and the tension member define a loading slot having a relatively wide cross sectional area permitting easy insertion of a leader portion of the roll of tissue therethrough.

U.S. Pat. No. 4,714,191 issued to Richardson entitled "Dispensing Carton For Plastic Bags" shows a one piece paperboard carton blank that is folded into a rectangular shape for packaging and dispensing from a roll of individual plastic bags, particularly disposable milk bottled for feeding babies. The carton has a double wall front part which includes an inner top rigidly supporting a tab protruding in a direction opposite to the direction of withdrawal of bags from the roll. When a first plastic bag is withdrawn it starts to pull out a succeeding bag to which it is removably attached along a line of perforations. When the center of the perforated edge of the succeeding bag is impaled on the tab, further withdrawal of the succeeding bag is restrained and the first bag is readily separated to facilitate its dispensing and to place the leading edge of the succeeding bag where it may be easily reached for withdrawal.

SUMMARY OF THE PRESENT INVENTION

The present invention provides an improved paper dispenser for roll type paper, and includes a container for dispensing the web of paper from a roll and wherein frictional contact between the roll and the container prevents excessive and inadvertent unwinding of the roll, while the free end of the web is maintained adjacent a cutting edge at all times. The apparatus includes a receptacle that is generally square in construction having a bottom, a front and rear side wall, opposed left and right side walls, a pivoting, hingedly attached top or lid, and with an interior space for holding the paper roll.

During use, the side walls and bottom of the receptacle frictionally hold the roll to prevent it from unwinding unnecessarily and excessively. An opening in the receptacle, preferably the pivoting lid, can be opened and closed for adding/removing the roll from the interior space of the receptacle.

A recess is formed in the receptacle at the intersection of the front wall and the lid to define an opening that allows the users thumb and one or more fingers to grasp the end of the web at the recess. The intersection of the lid and front wall defines a slot therebetween for dispensing the web from the receptacle interior via the slot. An arm disposed at least in part inside of the receptacle includes a portion that extends along the interior of the receptacle adjacent the free end of the web for holding the free end of the web adjacent the recess. The arm insures that the free end of the web is held in a position that allows it to be easily grasped by the user when additional paper is to be dispensed. A serrated or saw-like blade is provided for tearing a portion of the web adjacent the free end of the web. In the preferred embodiment, the arm is pivotally and loosely mounted to openings in the lid of the receptacle, at the forward edge of the lid.

In the preferred embodiment, the arm is attached to the lid and extends downwardly therefrom. The recess is formed in the lid portion of the receptacle in the preferred embodiment, defining a generally U-shaped slot having left and right side portions that communicate with left and right corresponding side portions of the arm.

In the preferred embodiment, the cutting blade has an upwardly facing serrated edge that is mounted the top of the front wall communicating along one edge of the slot.

In the preferred embodiment, the top or lid is hingedly pivotally mounted with respect to the side and front walls of the receptacle and carries the arm at its forward end portion as the lid is opened and closed, and the arm is weighted to automatically register against the web and front wall of the receptacle when the lid is closed.

In the preferred embodiment, the recess is positioned at the center front of the lid and the arm is supported in two spaced apart openings in the front of the lid adjacent the recess.

In the preferred embodiment, the roll rest upon the bottom of the receptacle during use and the web unrolls forwardly of the roll to a position adjacent the front wall of the receptacle, and wherein the arm holds the free end portion of the web against the front wall of the receptacle. In the preferred embodiment, a weight is provided that can be affixed to the roll for increasing the weight of the roll inside the receptacle enhancing frictional resistance between the roll and the receptacle.

In the preferred embodiment, the arm is U-shaped, having left and right side portions that are attached respectively on opposite sides of the recess, and the center of the arm carries an offset, rearwardly positioned weighted portion.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 2:
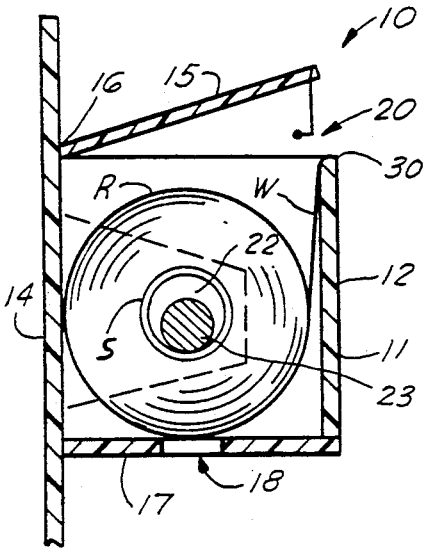
FIG. 2 is a sectional view taken along 2—2 of FIG. 1.
Figure 1:
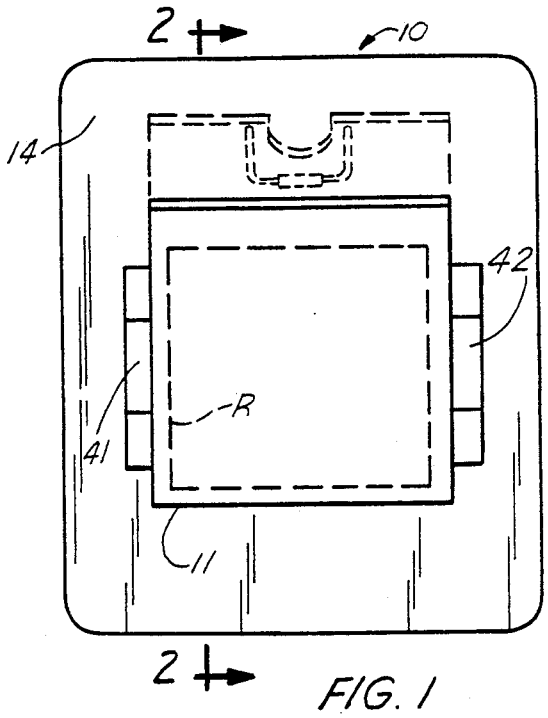
FIG. 1 is a front view of the preferred embodiment of the apparatus of the present invention.
Figure 4:
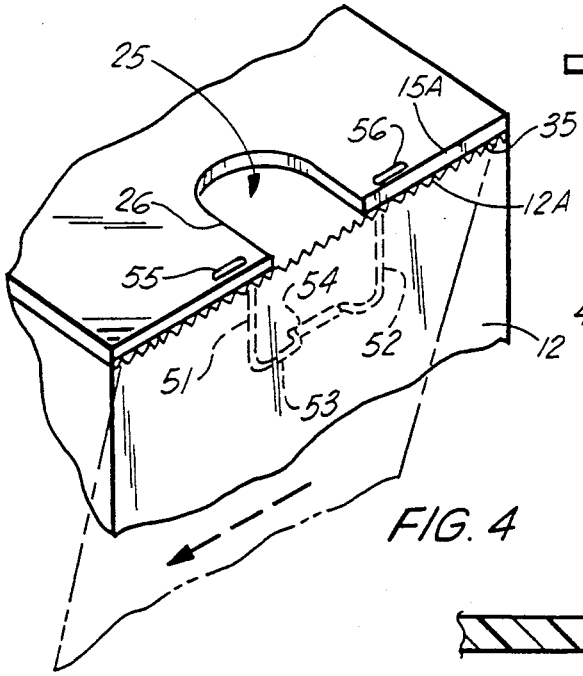
FIG. 4 is a fragmentary perspective view of the preferred embodiment of the apparatus of the present invention.

FIGS. 1 and 2 illustrate generally the preferred embodiment of the apparatus of the present invention designated generally by the numeral 10.

In FIGS. 1 and 2, there can be seen a receptacle or container, designated generally by the numeral 11 which includes front and rear side walls 12, 14, a lid 15 which is pivotally mounted at pivot 16 to rear of the receptacle or container and a bottom wall 17 having an opening 18 therein so that a user can put his or her finger through the opening 18 in order to remove a roll R from the receptacle interior 20. The receptacle is generally squared in construction, providing an interior 20 that can house the roll of paper. The roll can include a generally cylindrical hollow spool S having a bore 22 that can carry a weight 23 which is also generally cylindrical in construction and can be for example solid metal.

The weight 23 (e.g., approximately 3–4 ounces) helps hold the spool S in position even after the spool has dispensed almost all of its paper web W. This is important wherein the spools S is of a cardboard or other light weight material. The roll R provides a paper web W which is basically the unrolling portion of the paper stored on the roll R. The web includes a free end 30 which can be grasped by the user in order to pull the web upwardly and out of the box. Typically during use, the web extends forwardly of the roll R, along the front 12 portion of the container and is pulled through a slot 35 defined as the space between the forward edge 15A of lid 15 and the top edge 12A of front 12. Edge 12A carries a serrated cutting edge 40 so that the web W can be transversely torn or cut after a portion of paper is pulled outwardly depending upon the users needs. The lid 15 carries a recess 25 at its forward edge which is generally U-shaped when viewed from above. The recess 25 is spaced between its edges 26, 27 a distance wide enough so that a user can insert two or three fingers into the recess 25 and grasp the web W.

Figure 3:
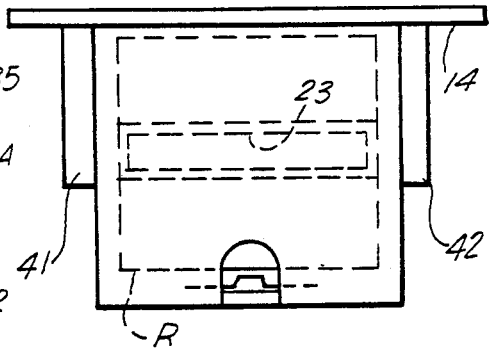
FIG. 3 is a top view of the preferred embodiment of the apparatus of the present invention.

The rear wall 14 could, for example, be a portion of an existing wall such as a tile wall in a bathroom if desired. The rear wall 14 could be mounted to a hanger having a pair of spaced apart flanges 41, 42 (FIGS. 1 and 3), that support the container 11 therebetween using for example double sided adhesive foam tape. The containers 11 could be in the form of a disposable box of cardboard, plastic or the like. The rear panel 14 could be a part of such a disposable box, or could be a permanent fixture or wall. The container 11 could be mounted to a wall using bolts, screws or the like.

Figure 5:
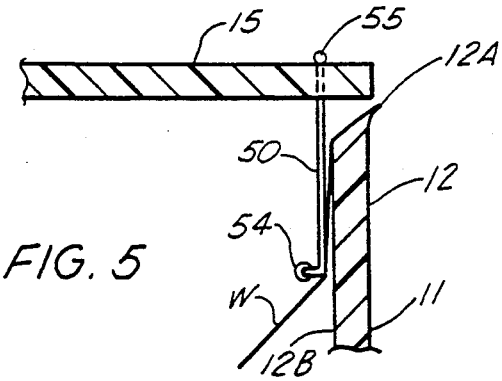
FIG. 5 is a fragmentary sectional view of the preferred embodiment of the apparatus of the present invention illustrating the lid, front, serrated edge and arm portions of the apparatus.

In FIG. 5, a fragmentary view illustrates the front panel 12 of container 11 carrying at its uppermost edge a forwardly extending serrated edge 12A for cutting or tearing the web W or paper which unrolls from the roll R. The web W is held closely against the inside surface 12B of container front wall 12. Arm 50 extends downwardly from the forward end portion of lid 15, being suspended therefrom. In the preferred embodiment, the arm 50 is preferably U-shaped having left 51 and right 52 strut portions which are generally vertically extending, and horizontal cross bar 53. A pair of spaced apart laterally extending hangers 55, 56 extend through the lid in provided spaced apart openings. The openings are slightly larger than the diameter of the vertical members 51, 52 so that the arm 50 can swing slightly, providing some looseness or play in its fore-aft movement with respect to lid 15. The counterweight 54 automatically registers the arm 50 in position against the inside surface 12B of container front 12 when the lid is closed. This configuration is shown in FIG. 5. When the lid 15 is in a closed position as shown in FIG. 5, the arm 50 holds the free end of the web W against the inside 12B and top surface of front 12 of container 11. The recess 25 provides an opening through which the user can insert one or two fingers in order to preliminarily grip the web W. The arm 50 secures the web W adjacent the recess 25 so that it is always held in a position where it can be quickly and easily grasped.

The container can be manufactured of any suitable structural material such as wood, plastic, cardboard or the like. However, a more permanent and stronger structure such as stainless steel, could be used. The arm 50 could be of a stainless steel wire material, using a counterweight 54 of lead, plastic, or wood for example.

Figure 6:
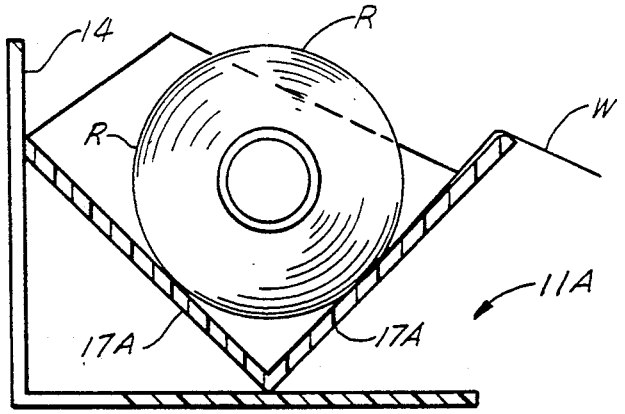
FIG. 6 is a sectional view of a second embodiment of the apparatus of the present invention.
Figure 7:
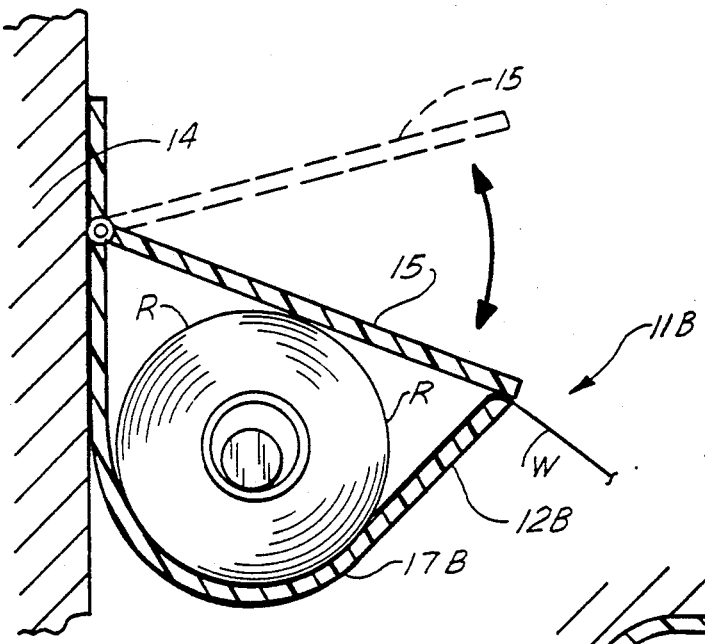
FIG. 7 is a sectional view of a third embodiment of the apparatus of the present invention.
Figure 8:
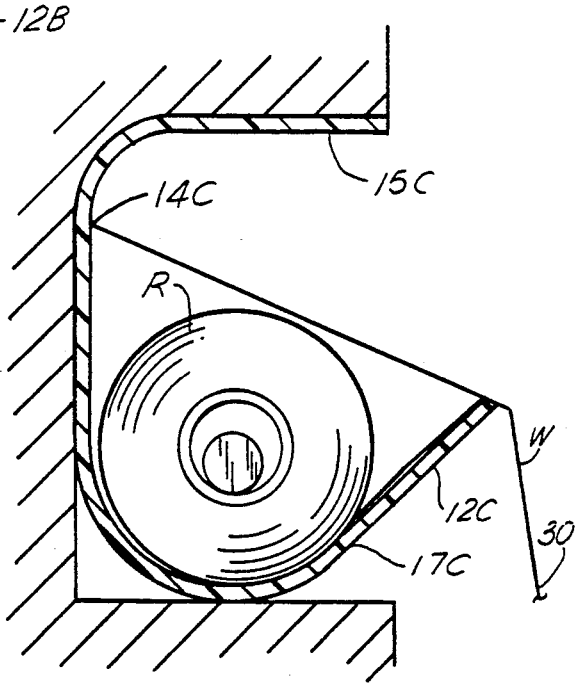
FIG. 8 is a sectional view of a fourth embodiment of the apparatus of the present invention.

In the embodiment of FIG. 6, the bottom 17A is V-shaped, and the roll R nests therein. In the embodiment of FIG. 7, the bottom 17B of receptacle 11B is a V-shaped structure that cradles the roll R. Front 12B is inclined forwardly. In the embodiment of FIG. 8, the receptacle 11C has a curved bottom 17C and an inclined front wall 12C. The rear wall 14C communicates with roof 15C, and the entire receptacle can be recessed in a wall as shown.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A container for dispensing a web of paper from a roll wherein the web unwinds from the bottom of the roll during use, comprising:

a) a receptacle having bottom, an upstanding transverse wall that angularly intersects the bottom wall so that the roll abuts the bottom wall and transverse wall at spaced apart positions of contact, opposed left and right sidewalls, and a top with an interior space for holding the paper roll;

b) an upper opening in the receptacle for adding/removing the roll from the interior space;

c) the receptacle including an upper surface for dispensing the web from the receptacle interior over the upper surface;

d) a weighted member mounted during use in the hollow transverse opening and independently of attachment to the receptacle, for continuously holding the roll against the receptacle as the roll decreases in size; and e) severing means at the front upper surface for severing a portion of the web adjacent the free end of the web.

2. The paper dispenser of claim 1 wherein weighted member is carried completely in the hollow transverse opening.

3. The paper dispenser of claim 1 wherein the severing means includes a serrated edged blade that is mounted along one edge of the slot.

4. A container for dispensing a web of paper from a roll wherein the web unwinds from the bottom of the roll during use, comprising:

a) a receptacle having bottom surface that supports at least some of the weight of the roll, opposed front and rear side walls, opposed left and right sidewalls, and a top with an interior space for holding the paper roll;

b) an opening in the receptacle that can be opened/closed for adding/removing the roll from the interior space;

c) a cutout recess formed in the receptacle at the intersection of the front wall and lid for defining an opening that allows a users thumb and fingers to grasp the free end of the web at the recess;

d) the intersection of the lid and front wall having a slot therebetween for dispensing the web from the receptacle interior via the slot;

e) an arm, suspended from the receptacle and including a portion that extends into the receptacle interior for holding the web against the receptacle in a position adjacent the recess so that the free end of the arm is held adjacent the recess and the slot; and f) severing means for severing a portion of the web adjacent the free end of the web, the severing means including a portion that communicates with the cutout recess.

5. A container for dispensing a web of paper from a roll wherein the web unwinds from the bottom of the roll during use, comprising:

a) a receptacle having bottom, opposed front and rear side walls, opposed left and right sidewalls, and a top with an interior space for holding the paper roll;

b) an opening in the receptacle that can be opened/closed for adding/removing the roll from the interior space;

c) the intersection of the lid and front wall having a slot therebetween for dispensing the web from the receptacle interior via the slot;

d) an arm, suspended from the receptacle and including a portion that extends into the receptacle interior for holding the web against the receptacle in a position adjacent the recess so that the free end of the arm is held adjacent the recess and the slot; and e) severing means for severing a portion of the web adjacent the free end of the web.

* * * * *